US011079084B2

(12) United States Patent
Xie

(10) Patent No.: US 11,079,084 B2
(45) Date of Patent: Aug. 3, 2021

(54) DIRECT-TYPE AUTOMOBILE HEADLAMP MODULE AND AUTOMOBILE HEADLAMP

(71) Applicant: HASCO VISION TECHNOLOGY CO., LTD., Shanghai (CN)

(72) Inventor: Le Xie, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 141 days.

(21) Appl. No.: 16/328,715

(22) PCT Filed: Jul. 26, 2017

(86) PCT No.: PCT/CN2017/094516
§ 371 (c)(1),
(2) Date: May 15, 2019

(87) PCT Pub. No.: WO2018/040808
PCT Pub. Date: Mar. 8, 2018

(65) Prior Publication Data

US 2019/0277470 A1 Sep. 12, 2019

(30) Foreign Application Priority Data

Aug. 31, 2016 (CN) ..... 201610792064.9

(51) Int. Cl.
*F21S 41/265* (2018.01)
*F21S 41/37* (2018.01)
(Continued)

(52) U.S. Cl.
CPC ..... *F21S 41/265* (2018.01); *F21S 41/143* (2018.01); *F21S 41/37* (2018.01); *F21S 45/48* (2018.01);
(Continued)

(58) Field of Classification Search
None
See application file for complete search history.

(56) References Cited

U.S. PATENT DOCUMENTS

2010/0135037 A1 6/2010 Tsukamoto
2016/0146418 A1* 5/2016 Iwasaki ..... F21S 41/143 362/520

(Continued)

FOREIGN PATENT DOCUMENTS

CN 103090285 A 5/2013
CN 204513199 U 5/2013
CN 204513198 U 7/2015

*Primary Examiner* — Britt D Hanley
(74) *Attorney, Agent, or Firm* — Global IP Services; Tianhua Gu

(57) ABSTRACT

A direct-type vehicle headlamp module, including a radiator, a light-emitting diode (LED) chip, and a lens, the radiator and the lens are fixed to form an accommodating cavity for accommodating the LED chip, the LED chip is fixed on the radiator, a light ray emitted by the LED chip is directly emitted through the lens, an outer surface of the lens is divided into three areas, curved surface shapes of outer surfaces of the areas are different from each other, a curved surface shape corresponding to a first area is configured to form a cut-off line shape, a curved surface shape corresponding to a second area is configured to increase brightness of a central area of a light shape, and a curved surface shape corresponding to a third area is configured to broaden the light shape. Transmission and emergence directions of the light ray having different curved surface shapes to form the cut-off line shape.

8 Claims, 3 Drawing Sheets

(51) Int. Cl.

| | |
|---|---|
| ***F21S 41/143*** | (2018.01) |
| ***F21S 45/48*** | (2018.01) |
| ***F21Y 115/10*** | (2016.01) |
| ***F21W 102/135*** | (2018.01) |

(52) U.S. Cl.
CPC .... *F21W 2102/135* (2018.01); *F21Y 2115/10* (2016.08)

(56) References Cited

U.S. PATENT DOCUMENTS

| | | | | |
|---|---|---|---|---|
| 2017/0045192 | A1* | 2/2017 | Peng | F21S 41/333 |
| 2018/0363874 | A1* | 12/2018 | Kawai | F21S 45/47 |

* cited by examiner

DIRECT-TYPE AUTOMOBILE HEADLAMP MODULE AND AUTOMOBILE HEADLAMP

CROSS REFERENCE TO RELATED PATENT APPLICATION

The present application is the US national stage of PCT/CN2017/094516 filed on Jul. 26, 2017, which claims the priority of the Chinese patent application No. CN2016107920649 filed on Aug. 31, 2016, which application is incorporated herein by reference.

BACKGROUND OF THE PRESENT INVENTION

Field of Invention

The present invention relates to the technical field of vehicle lamps, and in particular to a direct-type vehicle headlamp module and a vehicle headlamp.

Description of Related Arts

Currently, a common implementation mode of a light emitting diode (LED) vehicle headlamp is a reflective surface and a poly ellipsoid system module. The poly ellipsoid system module is also referred to as a PES (poly ellipsoid system) module. Because a reflective surface type headlamp needs to broaden a light shape, usually, a reflective surface 1 needs to be manufactured in a large and broad shape, which has a great influence on the appearance of the vehicle lamp, as shown in FIG. 1. On the other hand, although light is emitted from only one lens of the PES module, because there are many internal components, after light passes through a reflective surface, a light-shielding plate, and the lens, the emergent energy is less and the efficiency is low.

For example, Chinese Patent 201610110918.0 discloses a headlamp low-high beam light integrated light emitting diode PES unit, including a baffle, a transparent light-shielding plate, a lens, a low beam LED, and a high beam LED. The transparent light-shielding plate is rectangular and is disposed on a side of the baffle close to the lens, an upper end surface of the transparent light-shielding plate is flush or approximately flush with an upper end surface of the baffle. A focus of the lens is located on the upper end surface of the transparent light shielding plate. The low beam LED is located above the high beam LED. The PES unit of the present invention is used for a headlamp, that is, a PES module is formed. The low beam light needs to be emitted after passing through the reflective surface, the light shielding plate, and the lens. Consequently, there are more parts, light efficiency is low, and the cost is high.

Therefore, a vehicle headlamp module having a small structure, high efficiency, and low costs is needed.

SUMMARY OF THE PRESENT INVENTION

In view of the above-mentioned disadvantages of the prior art, an objective of the present invention is to provide a direct-type vehicle headlamp module and a vehicle headlamp, to solve a problem of complexity of a structure of the vehicle headlamp and low illumination efficiency in the prior art.

To achieve the foregoing objective and other related objectives, the present invention provides a direct-type vehicle headlamp module, including a radiator, a light emitting diode (LED) chip, and a lens, the radiator and the lens are fixed to form an accommodating cavity for accommodating the LED chip, the LED chip is fixed on the radiator, a light ray emitted by the LED chip is directly emitted through the lens, an outer surface of the lens is divided into three areas, curved surface shapes of outer surfaces of the areas are different from each other, a curved surface shape corresponding to a first area is configured to form a cut-off line shape, a curved surface shape corresponding to a second area is configured to increase brightness of a central area of a light shape, and a curved surface shape corresponding to a third area is configured to broaden the light shape.

Preferably, the three areas are defined by two intersection lines that perpendicularly intersect with each other, an intersection point of the two intersection lines is located on an optical axis of a light ray emitted by the LED chip, the first area is an upper left one-quarter outer surface defined by the two intersection lines, the second area is an upper right one-quarter outer surface defined by the two intersection lines, and the third area is a lower-half outer surface defined by the two intersection lines.

Preferably, the third area is a left-right symmetric structure.

Preferably, the radiator is provided with a boss for reflecting light below and on one side of a position at which the LED chip is fixed.

Preferably, a top surface of the boss is an inclined plane sloping downward in a direction extending toward the lens.

Preferably, the inclined plane and a vertical inner surface of the lens form an angle of 45° to 55°.

Preferably, a top surface of the boss is plated with aluminum.

Preferably, the radiator is provided with a plurality of heat dissipation fins distributed at intervals.

The present invention further provides a vehicle headlamp, using the above-mentioned direct-type vehicle headlamp module.

As stated above, the direct-type vehicle headlamp module and the vehicle headlamp of the present invention have the following beneficial effects: the present invention uses a direct type principle, that is, a light ray emitted by an LED chip is directly projected to a lens, the lens directly collects the light ray without using a reflective surface, and an outer surface of the lens is divided into three areas. Curved surface shapes of outer surfaces of the areas are different from each other, a curved surface shape corresponding to a first area is configured to form a cut-off line shape, a curved surface shape corresponding to a second area is configured to increase brightness of a central area of a light shape, and a curved surface shape corresponding to a third area is configured to broaden the light shape. Transmission and emergence directions of the light ray are controlled through the three areas having different curved surface shapes to form the cut-off line shape. Because the light ray only passes through the lens, the light efficiency is high, and the cost is low.

DESCRIPTION OF COMPONENT REFERENCE NUMERALS

Figure 1:
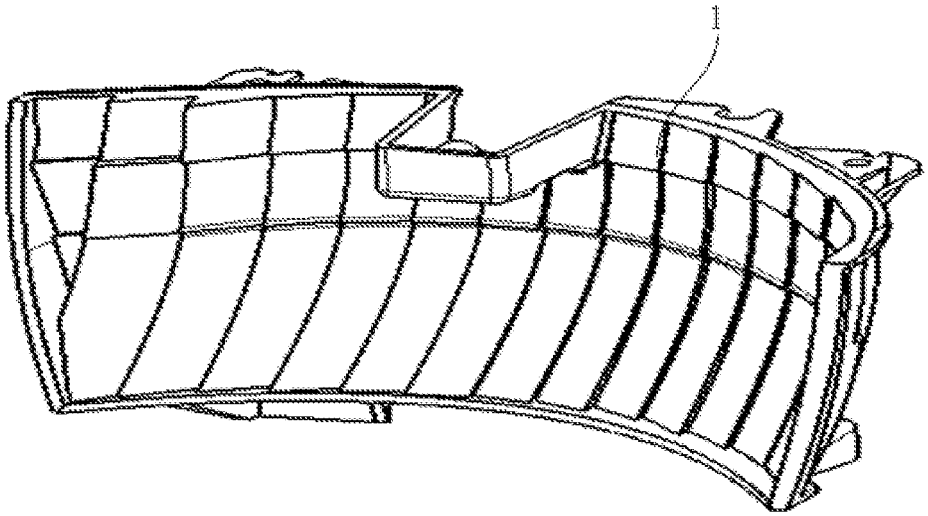
FIG. 1 is a schematic diagram of a reflective surface.

1 Reflective surface
2 Radiator
21 Heat dissipation fin
22 Boss
3 Lens
31 First area
32 Second area
33 Third area
4 LED chip

DETAILED DESCRIPTION OF THE PREFERRED EMBODIMENTS

The implementation mode of the present invention will be described below through specific embodiments. One skilled in the art can easily understand other advantages and effects of the present invention according to contents disclosed by the description.

Referring to FIG. 2 to FIG. 5. It should be known that all structures, ratios, sizes, and the like drawn in the accompanying drawings of this specification are used only to match the content disclosed in this specification for those skilled in the art to learn and read and are not limitation conditions intended to limit implementation of the present invention, and therefore do not have technically substantial meanings. Any modification of a structure, change of a ratio relationship, and adjustment of a size all fall within the scope covered by the technical content disclosed in the present invention without affecting effects to be produced by the present invention and objectives to be achieved by the present invention. In addition, terms such as "up", "down", "left", "right", "middle", and "one" cited in this specification are only for the purpose of clearness of statement and are not intended to limit the scope of implementation of the present invention. Change or adjustment of a relative relationship thereof should be regarded as the scope of implementation of the present invention without substantially changing the technical content.

Figure 2:
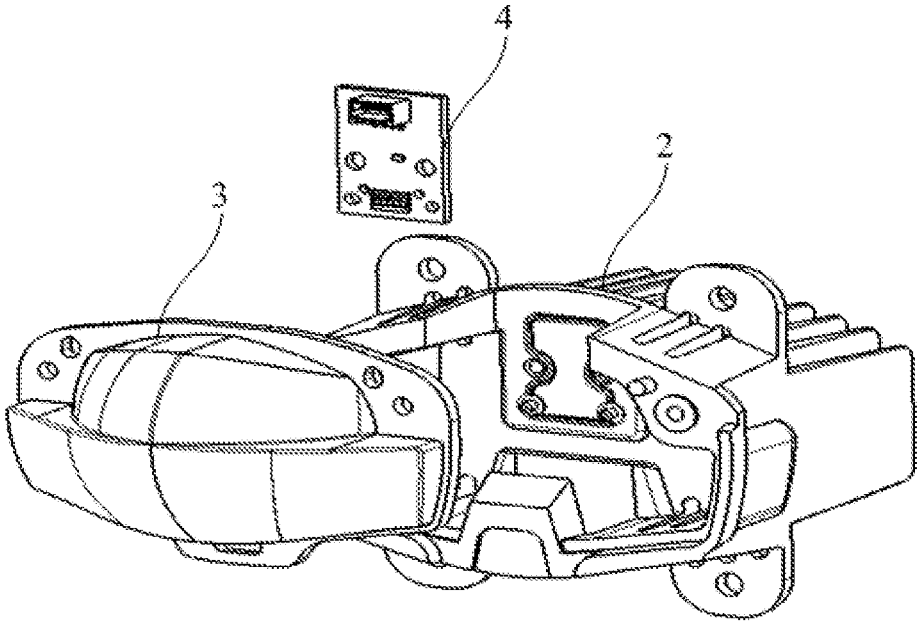
FIG. 2 is a schematic exploded diagram of a direct-type vehicle headlamp module of the present invention.
Figure 3:
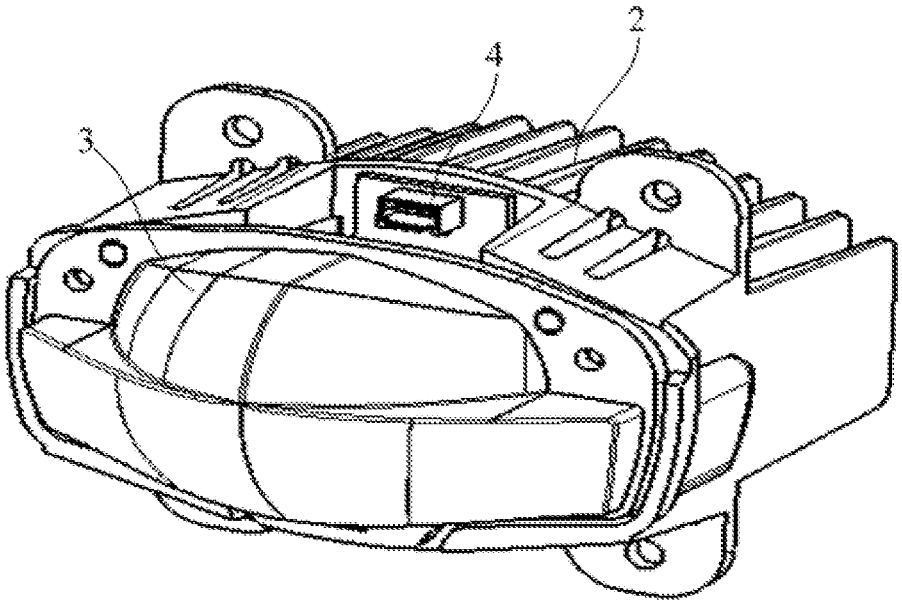
FIG. 3 is an overall diagram of the direct-type vehicle headlamp module of the present invention.
Figure 5:
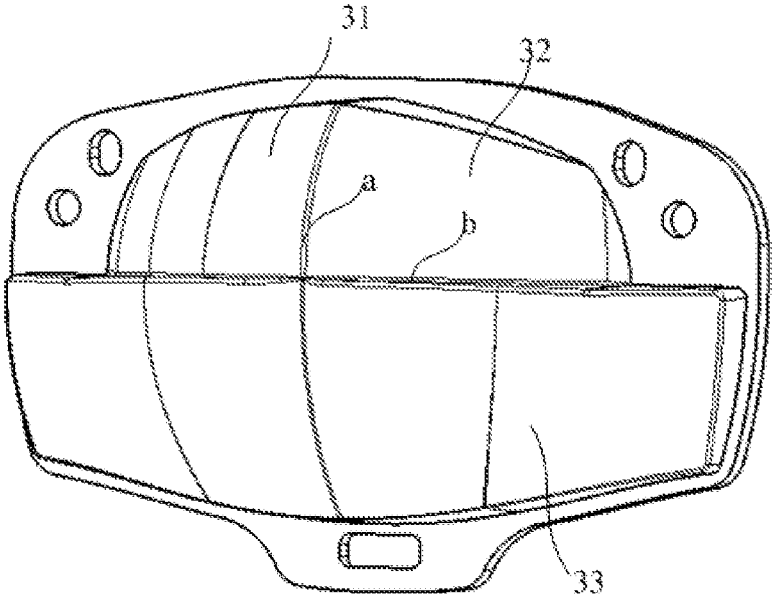
FIG. 5 is a schematic diagram of a lens of the present invention.

As shown in FIG. 2 and FIG. 3, the present invention provides a direct-type vehicle headlamp module, including a radiator 2, a light emitting diode (LED) chip 4, and a lens 3. The radiator 2 and the lens 3 are fixed to form an accommodating cavity for accommodating the LED chip 4. The LED chip 4 is fixed on the radiator 2. A light ray emitted by the LED chip 4 is directly emitted through the lens 3. An outer surface of the lens 3 is divided into three areas. As shown in FIG. 5, curved surface shapes of outer surfaces of the areas are different from each other; a curved surface shape corresponding to a first area 31 is configured to form a cut-off line shape, a curved surface shape corresponding to a second area 32 is configured to increase brightness of a central area of a light shape, and a curved surface shape corresponding to a third area 33 is configured to broaden the light shape.

In the present invention, a light ray emitted by an LED chip is directly projected to a lens, that is, the lens directly collects the light ray without using a reflective surface. An outer surface of the lens is divided into three areas, and curved surface shapes of outer surfaces of the areas are different from each other. Transmission and emergence directions of the light ray are controlled through the three areas having different curved surface shapes to form a cut-off line shape. Because the light ray only passes through the lens, there are no excessive parts in the optical path, so that optical energy loss is reduced, light efficiency is relatively high, and the direct-type vehicle headlamp module has a simple and compact structure and a smaller volume.

To better improve efficiency, the three areas are defined by two intersection lines that perpendicularly intersect with each other. As shown in FIG. 5, an intersection point of the two intersection lines (a line a and a line b in FIG. 5) is located on an optical axis of a light ray emitted by the LED chip 4. The first area 31 is an upper left one-quarter outer surface defined by the two intersection lines. The left, right, upper, and lower herein all refer to the left, right, upper, and lower in FIG. 5. The second area 32 is an upper right one-quarter outer surface defined by the two intersection lines, and the third area 33 is a lower-half outer surface defined by the two intersection lines. The third area 33 has a left-right symmetric structure, and the first area 31 and the second area 32 are asymmetric. The outer surface (that is, a front surface of the lens when in use) of the lens is divided into three areas by interacting the line a and the line b in FIG. 5, to accurately design curved surface shapes of the areas, so that each area better implements a respective function, and a better cut-off line shape is formed.

Figure 4:
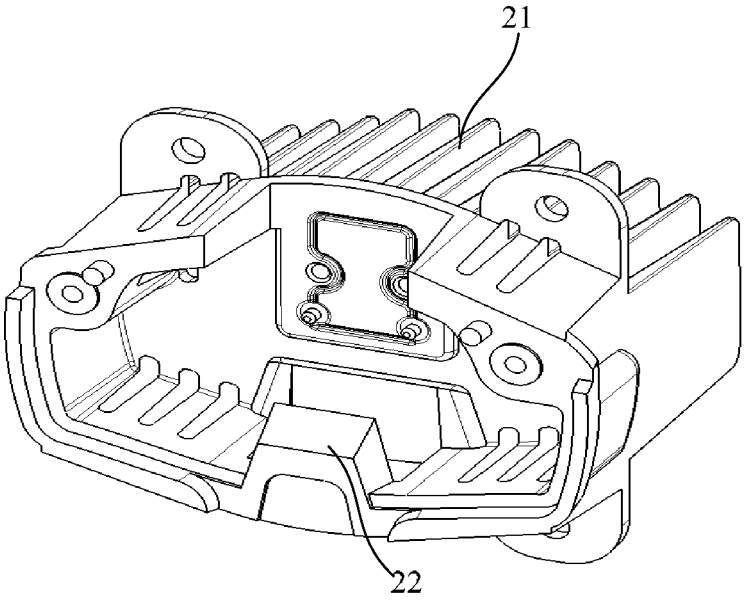
FIG. 4 is a schematic diagram of a radiator of the present invention.

As shown in FIG. 4, the radiator 2 is provided with a boss 22 for reflecting light below and on one side of a position at which the LED chip is fixed. The boss exists mainly to satisfy requirements on three areas of an LED headlamp for a vehicle under the GB25991-2010 standard. To better reflect the light ray emitted by the LED chip, a top surface of the boss 22 is an inclined plane sloping downward in a direction extending toward the lens 3. The inclined plane and a vertical inner surface of the lens 3 form an angle of 45° to 55°. A top surface of the boss 22 is plated with aluminum.

In addition to being configured to fasten the LED chip 4 and ensure a distance between the LED chip 4 and the lens 3, the radiator 2 is further configured to help the LED chip to passively dissipate heat and prevent the LED chip from overheating and burning out. The radiator 2 is provided with a plurality of heat dissipation fins 21 distributed at intervals. The heat dissipation fins and a hollow structure increase a contact area with air, to achieve better heat dissipation.

The present invention further provides a vehicle headlamp, using the above-mentioned direct-type vehicle headlamp module, to improve illumination efficiency.

In conclusion, in the direct-type vehicle headlamp module and the vehicle headlamp of the present invention, because the light ray only passes through the lens, there are no excessive parts in the optical path, so that optical energy loss is reduced, light efficiency is high, and the direct-type vehicle headlamp module has a simple and compact structure, a smaller volume, and a high stability. Therefore, the present invention effectively overcomes various disadvantages in the prior art and has a high industrial utilization value.

The above-mentioned embodiments are just used for exemplarily describing the principle and effects of the present invention instead of limiting the present invention. One skilled in the art can make modifications or changes to the above-mentioned embodiments without going against the spirit and the range of the present invention. Therefore, all equivalent modifications or changes made by those who have common knowledge in the art without departing from the spirit and technical concept disclosed by the present invention shall be still covered by the claims of the present invention.

What is claimed is:

1. A direct-type vehicle headlamp module; comprising:

a radiator (2), a light-emitting diode (LED) chip (4), and a lens (3);

the radiator (2) and the lens (3) are fixed to form an accommodating cavity for accommodating the LED chip (4), the LED chip (4) is fixed on the radiator (2), a light ray emitted by the LED chip (4) is directly emitted through the lens (3);

an outer surface of the lens (3) is divided into a first area (31), a second area (32), and a third area (33) by two intersection lines that perpendicularly intersect with each other, the first area (31) is an upper left one-quarter outer surface defined by the two intersection lines, the second area (32) is an upper right one-quarter outer surface defined by the two intersection lines, and the third area (33) is a lower-half outer surface defined by the two intersection lines, an intersection point of the two intersection lines is located on an optical axis of a light ray emitted by the LED chip (4);

each curved surface shape of the first, second and third areas are different from each other, the curved surface shape corresponding to a first area (31) is configured to form a cut-off line shape, the curved surface shape corresponding to a second area (32) is configured to increase brightness of a central area of a light shape, and the curved surface shape corresponding to a third area (33) is configured to broaden the light shape.

2. The direct-type vehicle headlamp module as in claim 1, wherein the third area (33) is a left-right symmetric structure.

3. The direct-type vehicle headlamp module as in claim 1, wherein the radiator (2) is provided with a boss (22) for reflecting light below and on one side of a position at which the LED chip is fixed.

4. The direct-type vehicle headlamp module as in claim 3, wherein a top surface of the boss (22) is an inclined plane sloping downward in a direction extending toward the lens (3).

5. The direct-type vehicle headlamp module as in claim 4, wherein the inclined plane and a vertical inner surface of the lens (3) form an angle of 45° to 55°.

6. The direct-type vehicle headlamp module as in claim 3, wherein a top surface of the boss (22) is plated with aluminum.

7. The direct-type vehicle headlamp module as in claim 1, wherein the radiator (2) is provided with a plurality of heat dissipation fins (21) distributed at intervals.

8. A vehicle headlamp, using the direct-type vehicle headlamp module as in claim 1.

* * * * *